US005735617A

United States Patent [19]

Wirth

[11] Patent Number: 5,735,617

[45] Date of Patent: Apr. 7, 1998

[54] ADJUSTABLE PRINTHEAD MOUNT FOR DOCUMENT IMAGING APPARATUS

[75] Inventor: Henry George Wirth, Rochester, N.Y.

[73] Assignee: Eastman Kodak Company, Rochester, N.Y.

[21] Appl. No.: 886,846

[22] Filed: Jul. 1, 1997

Related U.S. Application Data

[63] Continuation of Ser. No. 655,030, May 29, 1996, abandoned.

[51] Int. Cl.[6] ..... B41J 2/27

[52] U.S. Cl. ..... 400/120.17; 400/198

[58] Field of Search ..... 400/120.01, 120.16, 400/120.17; 347/197, 198

[56] References Cited

U.S. PATENT DOCUMENTS

| | | | |
|---|---|---|---|
| 4,000,393 | 12/1976 | Cochran et al. | 400/120.16 |
| 4,170,422 | 10/1979 | Bilek | 400/120.16 |
| 4,708,500 | 11/1987 | Bangs et al. | 400/120.17 |
| 4,884,904 | 12/1989 | Berquist | 347/198 |
| 4,962,392 | 10/1990 | Okuno et al. | 347/197 |
| 5,023,628 | 6/1991 | Koch | 400/120.16 |
| 5,055,858 | 10/1991 | Koch | 347/197 |
| 5,157,415 | 10/1992 | Seyasu | 400/120.17 |
| 5,172,137 | 12/1992 | Hongo et al. | 347/198 |
| 5,176,458 | 1/1993 | Wirth | 400/120.16 |
| 5,304,007 | 4/1994 | Flanagan | 400/120.16 |
| 5,477,258 | 12/1995 | Koo | 347/197 |
| 5,507,582 | 4/1996 | Mistyruik | 400/120.16 |
| 5,520,471 | 5/1996 | Leys et al. | 400/120.16 |

FOREIGN PATENT DOCUMENTS

| | | | |
|---|---|---|---|
| 0059355 | 2/1990 | Japan | 347/197 |
| 0112953 | 4/1990 | Japan | 347/197 |
| 0207666 | 9/1991 | Japan | 347/197 |
| 0169689 | 7/1993 | Japan | 347/198 |
| 0099642 | 4/1994 | Japan | 347/198 |

*Primary Examiner*—Christopher A. Bennett
*Attorney, Agent, or Firm*—Milton S. Sales

[57] ABSTRACT

A printhead assembly includes a member which cooperates with other printer structure to hold the printhead assembly in the printer An elongated printhead has a linear array of print elements that extend across at least a substantial portion of an image so as to produce a print line with a predetermined contour. The member and the mount are adjustably connected along the length of the printhead to locally vary the space between the mount and the member, whereby the shape of the printhead can be changed to adjust the contour of the print line.

12 Claims, 5 Drawing Sheets

ADJUSTABLE PRINTHEAD MOUNT FOR DOCUMENT IMAGING APPARATUS

This is a Continuation of application Ser. No. 08/655,030, filed 29 May 1996 now abandoned.

BACKGROUND OF THE INVENTION

1. Technical Field

This invention relates generally to linear printheads for document imaging apparatus such as printers, copiers, facsimiles, and the like; and more particularly to the adjustment of the shape of the linear printheads during or after assembly.

2. Background Art

Document imaging apparatus often includes a linear array of print elements that extend across a substantial portion, if not all, of the width of the image to be produced. In many cases, the printhead is assembled to a mount that positions the printhead relative to an imaging plane. When the printhead is assembled to the mount, the contour, or shape, of the line of print elements may be distorted from a desired shape.

My commonly assigned U.S. Pat. No. 5,176,458, which issued on Jan. 5, 1993, discloses a thermal printer having an array of resistive heater elements assembled in a printhead that is attached to a heat sink. During manufacture of the printer, the printhead was assembled to the heat sink, and the contour of the print line was measured. If the measured contour was unacceptable, the printhead was disassembled, reassembled, and re-measured until an acceptable print line contour was achieved. These methods resulted in undesirably high assembly times and costs.

Shims or spacers may be added between the printhead and the heat sink to provide a desired print line contour. Unfortunately, such shims or spacers degrade the thermal interface between the printhead and the heat sink, thereby diminishing performance of the printer.

DISCLOSURE OF THE INVENTION

It is an object of the present invention to provide a printhead mount that allows adjustment of the print line contour after assembly of the printhead to the mount.

It is another object of the present invention to provide a printhead mount that allows adjustment of the print line contour without the use of shims or spacers between the printhead and the mount.

According to a feature of the present invention, a printhead assembly includes a member which cooperates with other printer structure to hold the printhead assembly in the printer. An elongated printhead has a linear array of print elements that extend across at least a substantial portion of an image so as to produce a print line with a predetermined contour. The member and the mount are adjustably connected along the length of the printhead to locally vary the space between the mount and the member, whereby the shape of the printhead can be changed to adjust the contour of the print line.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a thermal printer, it will be noted that the invention can be used with other types of imaging apparatus.

Figure 1:
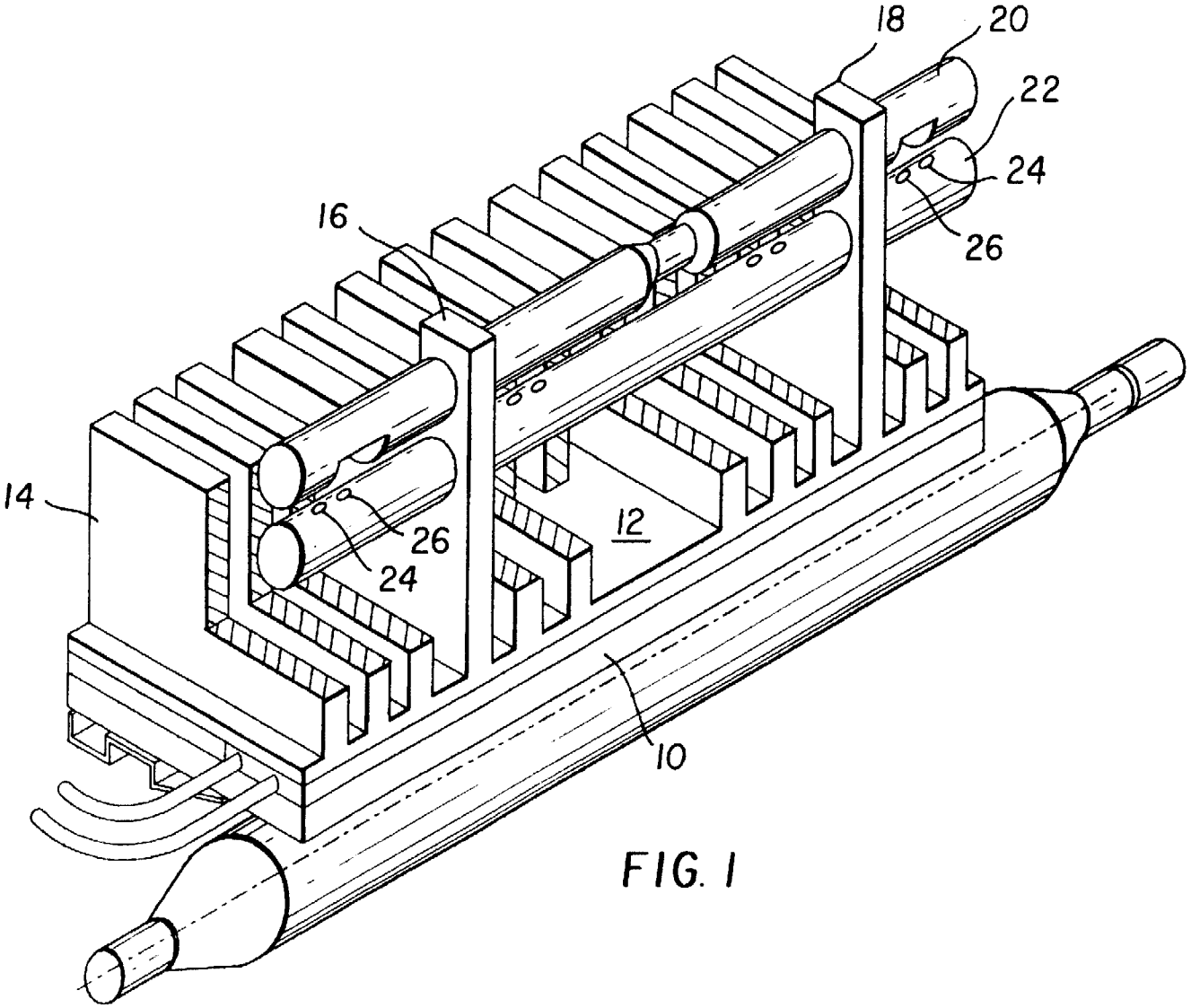
FIG. 1 is a partially sectioned, perspective view of a printhead assembly and platen according to the present invention.
Figure 2:
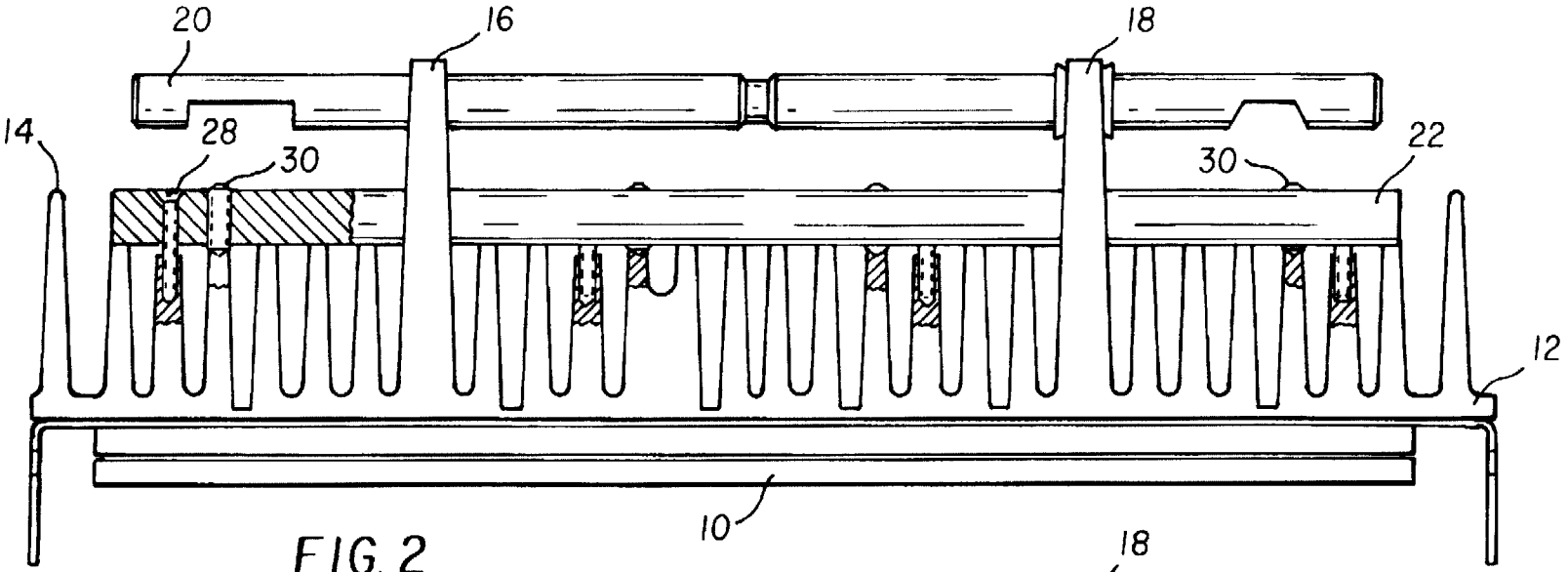
FIG. 2 is a front elevation view of the printhead assembly of FIG. 1.
Figure 3:
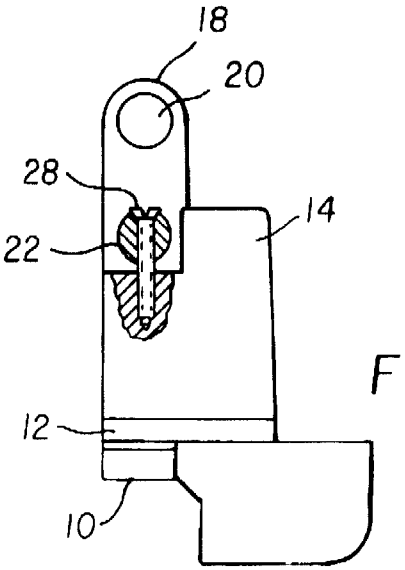
FIG. 3 is a side elevation view of the printhead assembly of FIGS. 1 and 2.

Referring to FIGS. 1–3, a printhead 10 having a linear array of print elements, not shown, that extend across a substantial portion, if not all, of the width of an image to be produced is attached to a mount 12 that, in the case of a thermal printhead, is a heat sink. The heat sink mount has a plurality of cooling fins 14, two of which, fins 16 and 18, extend beyond the other fins.

Cooling fins 16 and 18 have two holes that slip over an attachment member, which is shown in FIGS. 2 and 3 as a shaft 20. Other holes in cooling fins 16 and 18 slip over a shape-retention member that, in the illustrated embodiment, is a shaft 22. Attachment member shaft 20 has features that cooperate with other printer structure to hold the printhead assembly in the printer.

Shape retention member shaft 22 has an adjustable connection to mount 12, including a plurality of hole pairs 24 and 26 along the length of the shaft. Each hole aligns with one of the cooling fins of mount 12. One 24 of the holes of each pair is untapped, and aligns with a tapped hole in the top of its associated fin. A screw 28 extends through the untapped hole in shaft 22 and into the tapped hole in the fin such that the fin can be drawn toward the shaft by tightening the screw.

The other 26 of the holes of each pair is tapped, and aligns with the top of its associated fin. A screw 30 extends through the tapped hole in shaft 22 and into butting engagement with the fin such that the fin can be pushed away from the shaft by tightening the screw.

After the printhead has been assembled to the mount, the contour of the print line of the printhead is measured. A technician can then modify the print line by adjustment of the screw pairs.

Figure 4:
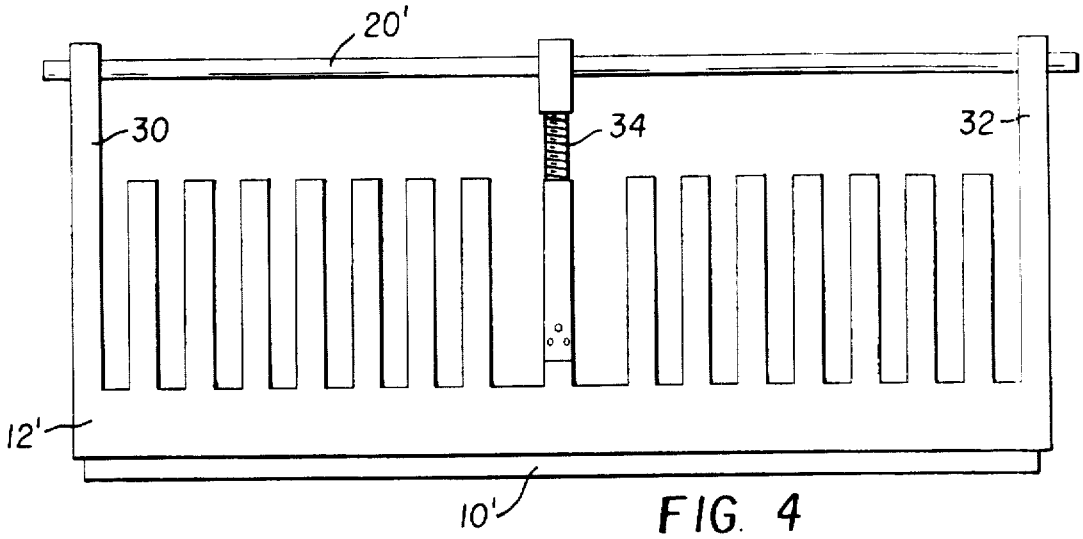
FIGS. 4–6 are front elevational views of another embodiment of the present invention in different adjusted contours.
Figure 5:
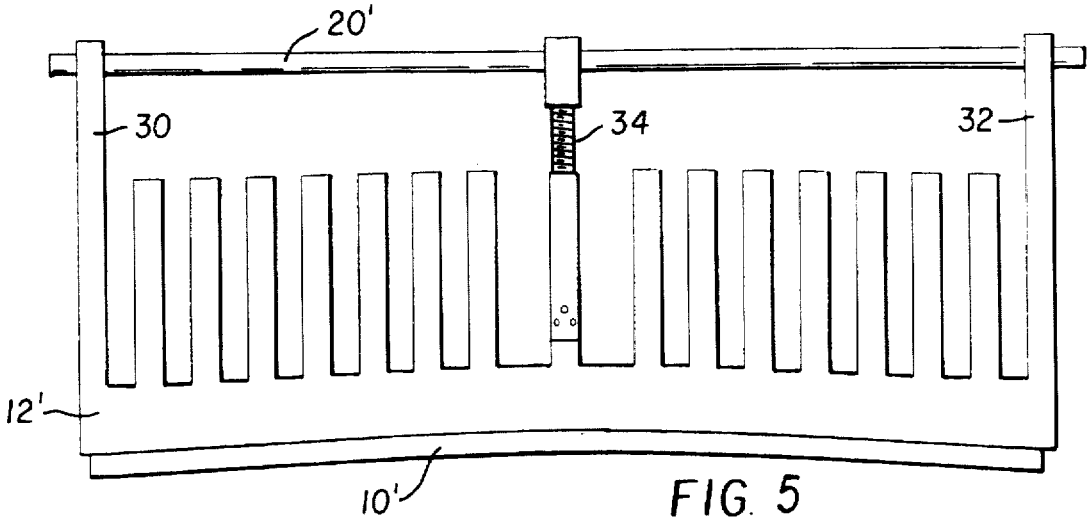
Figure 6:
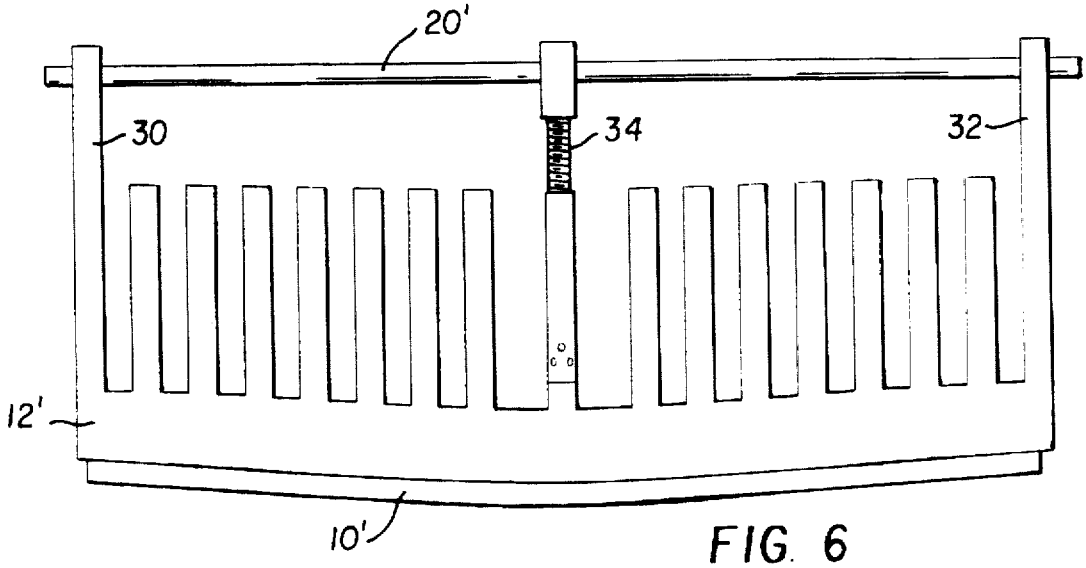

FIGS. 4–6, show a second embodiment of the present invention, wherein a heat sink printhead mount 12' for printhead 10' is attached to a shape retention member shaft 20' which, in this embodiment, is also used as an attachment member to hold the printhead assembly in the printer. In this embodiment, two 30 and 32 of three points of attachment of mount 12' to shaft 20' are fixed, and the third point of attachment forms an adjustable connection 34. A technician can modify the print line contour by lengthening or shortening adjustable connection 34. FIG. 5 shows the printhead assembly when adjustable connection 34 has been shortened, while FIG. 6 shows the printhead assembly when adjustable connection 34 has been lengthened. Thus, a simple, one-point adjustment that affects the central portion of the contour of the print line is provided.

Figure 7:
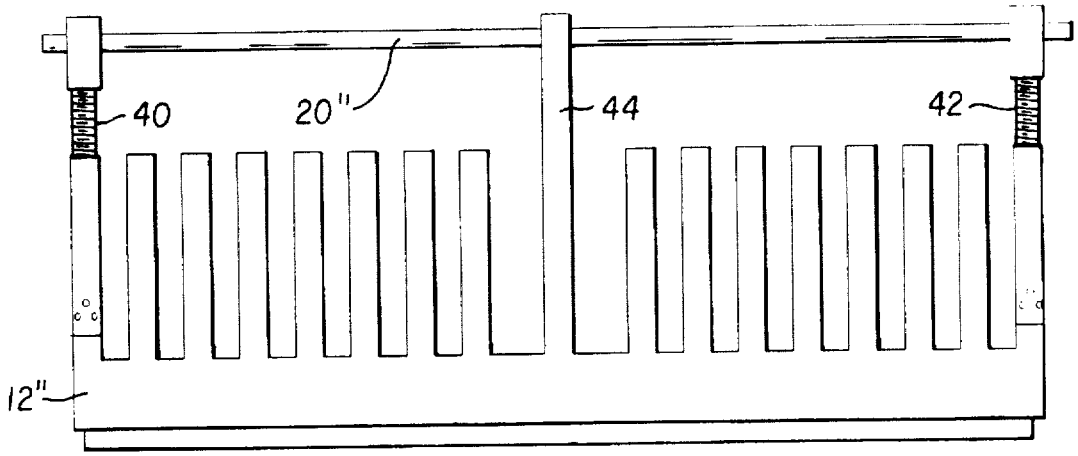
FIGS. 7–9 are front elevational views of still another embodiment of the present invention in different adjusted contours.
Figure 8:
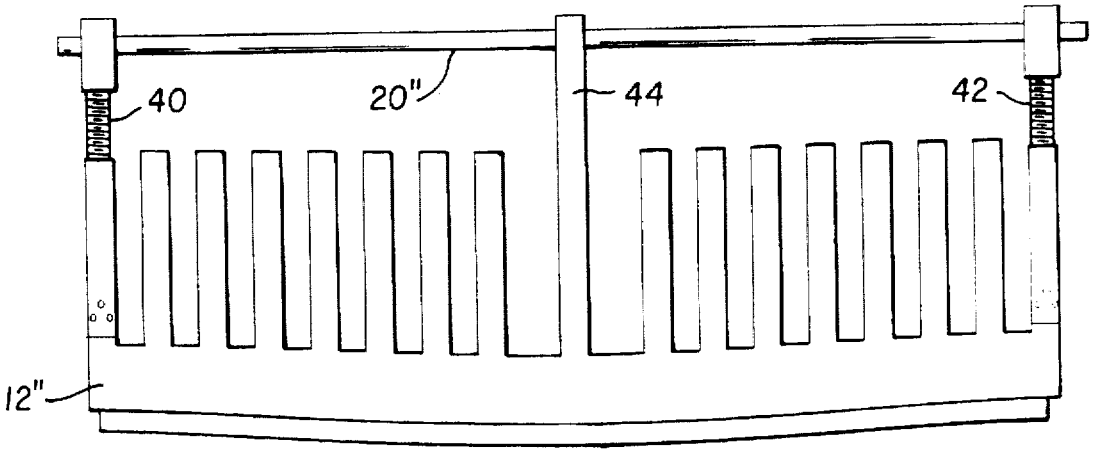
Figure 9:
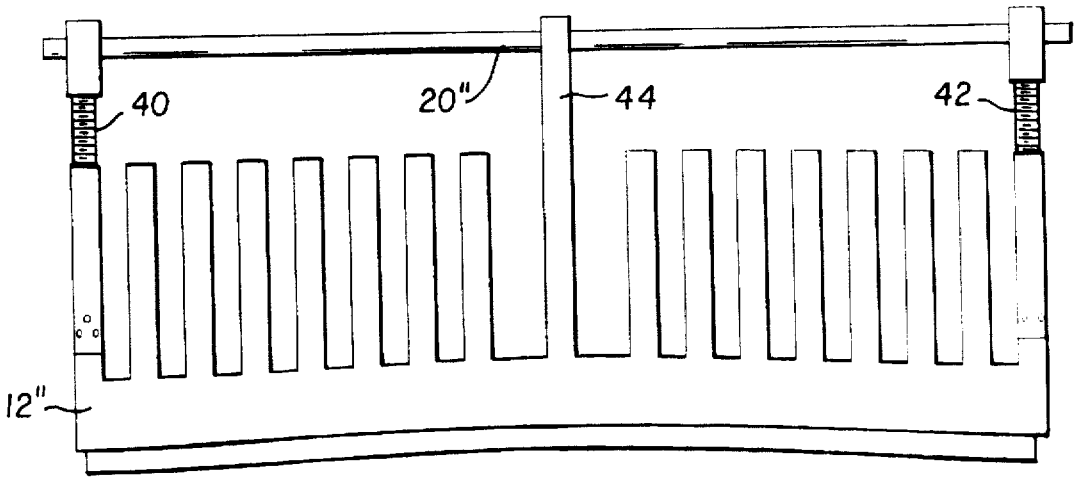

FIGS. 7–9 show a third embodiment of the present invention, wherein a printhead mount 12" is attached to a shape retention member shaft 20" which, in this embodiment, is also used as an attachment member to hold the printhead assembly in the printer. In this embodiment, two 40 and 42 of three points of connection of printhead mount 12" to shaft 20" are adjustable, and a third point of attachment 44 is fixed. A technician can modify the print line contour by lengthening or shortening adjustable connections 40 and 42. FIG. 8 shows the printhead assembly when the adjustable connections have been shortened to produce an essentially convex print line contour, while FIG. 9 shows the printhead assembly when the adjustable connections have been lengthened to produce an essentially concave print line contour.

Figure 10:
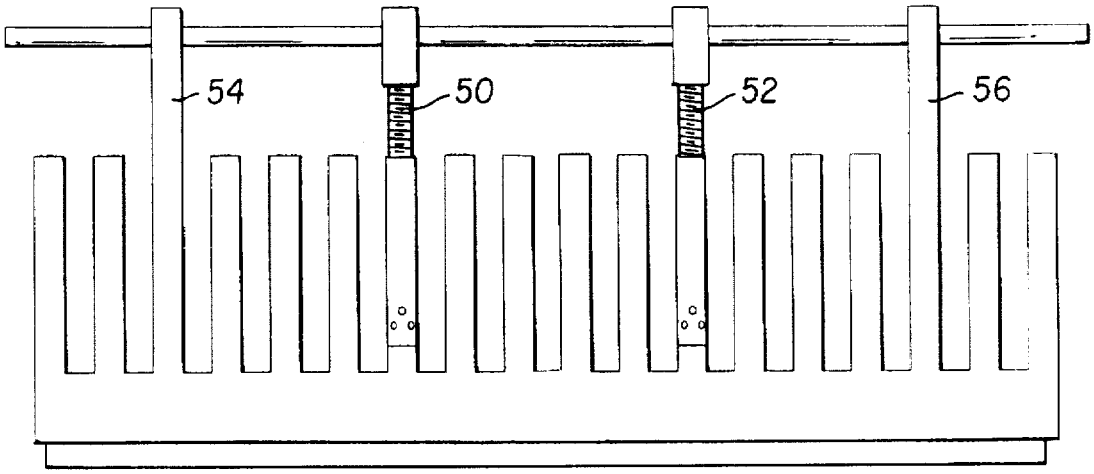
FIGS. 10 and 11 are front elevational views of yet another embodiment of the present invention in different adjusted contours.
Figure 11:
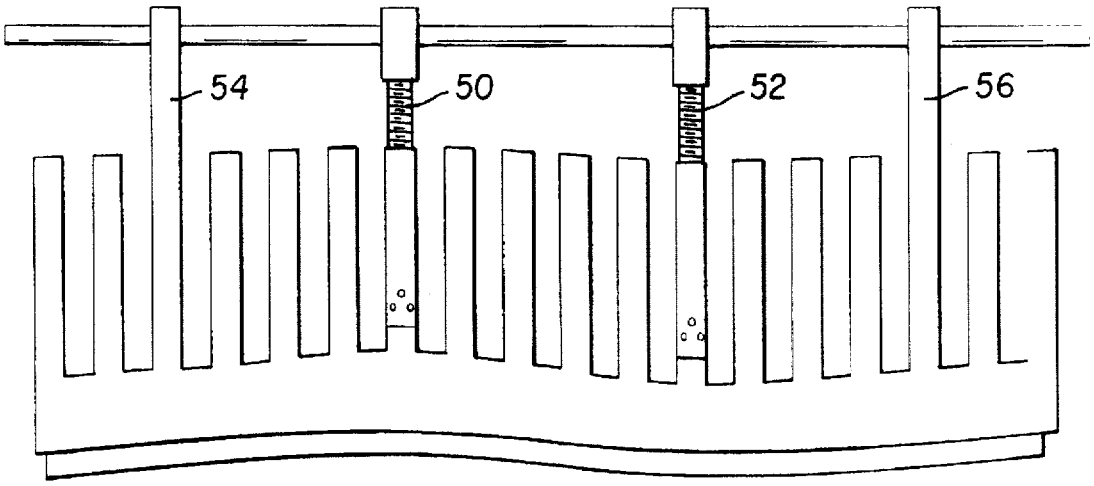

FIGS. 10 and 11 show a fourth embodiment of the present invention, wherein a heat sink is attached to a shape retention member shaft which, in this embodiment, is also used as an attachment member to hold the printhead assembly in the printer. Two adjustable connection links 50 and 52, and two fixed links 54 and 56 connect the shape retention member to the printhead mount. In FIG. 10, the adjustable connection links are both located in the central region of the mount and the fixed connection links are located near respective ends of the mount. This embodiment can be adjusted to provide more complicated print line contours, such as that shown in FIG. 11, in which one adjustable connection link has been shortened and the other lengthened to produce an essentially "S" shaped print line contour. The adjustable connection links could also provide essentially convex or concave contours.

Another embodiment, not shown, would be similar to that of FIGS. 10 and 11, except that the fixed connection links are both located in the central region of the mount and the adjustable connection links are located near respected ends of the mount.

Advantages

According to the above, it is found that the present invention offers the following advantages:

1. Single assembly operation of the printhead assembly to the printer.
2. Ability to adjust the print line to simple or complex shapes.
3. Quick, easy adjustments.
4. Field or factory implementation.
5. Adjustment of the print line without disassembly.
6. Does not alter or reduce the thermal interface between the printhead and the heat sink as would shims or spacers.

The invention has been described in detail with particular reference to preferred embodiments thereof, but it will be understood that variations and modifications can be effected within the spirit and scope of the invention.

What is claimed is:

1. A printhead assembly comprising:

a member that cooperates with printer structure to hold the printhead assembly in the printer;

an elongated printhead having a length and a linear array of print elements that extend along the length of the printhead across at least a substantial portion of an image to be produced so as to produce a print line with a predetermined contour; and a shimless connection between the member and the printhead so as to space the printhead from the member, said connection being adjustable along the length of the printhead to locally vary the space between the printhead and the member, whereby the shape of the printhead can be changed to adjust the contour of the print line.

2. A printhead assembly as set forth in claim 1 further comprising a mount between the printhead and the member, said printhead being attached along its length to the mount and said connection being attached to the member and the mount.

3. A printhead assembly as set forth in claim 2 wherein the mount is a heat sink.

4. A printhead assembly as set forth in claim 3 wherein the heat sink has a plurality of cooling fins to which the connection is attached.

5. A printhead assembly as set forth in claim 4 further comprising a plurality of cooling fins in addition to the plurality of cooling fins to which the connection is attached, wherein the plurality of cooling fins to which the connection is attached are intermediate fins in addition to the plurality of cooling fins to which the connection is attached.

6. A printhead assembly as set forth in claim 5 wherein:

the member includes a shaft;

the plurality of fins to which the connection is attached have two holes that slip over the shaft; and the connection extends between the shaft and at least some of the cooling fins.

7. A printhead assembly as set forth in claim 6 wherein:

the shaft has a plurality of holes along the length of the shaft, each of the holes aligning with an associated one of the cooling fins of the mount;

a tapped hole in the top of the associated cooling fins;

the holes are untapped, and align with a tapped hole in the top of its associated cooling fin; and a plurality of screws extend respectively through the untapped holes in the shaft and into the tapped holes in the associated cooling fins such that the cooling fins can be selectively and locally drawn toward the shaft by adjusting selected ones of the screws.

8. A printhead assembly as set forth in claim 7 wherein:

the shaft has another plurality of holes along the length of the shaft, each of the other plurality of holes aligning with an associated one of the cooling fins of the mount;

the other plurality of holes is tapped, and aligns with the top of its associated cooling fin; and a second plurality of screws extends respectively through the tapped holes in the shaft and into butting engagement with the associated cooling fin such that the cooling fin can be selectively and locally pushed away from the shaft by adjusting the second plurality of screws.

9. A printhead assembly as set forth in claim 6 wherein:

the shaft has a plurality of holes along the length of the shaft, each of the holes aligning with an associated one of the cooling fins of the mount;

the plurality of holes is tapped, and aligns with the top of its associated cooling fin; and a plurality of screws extends respectively through the tapped holes in the shaft and into butting engagement with the associated cooling fin such that the cooling fin can be selectively and locally pushed away from the shaft by adjusting the screw.

10. A printhead assembly as set forth in claim 2 wherein:

the member has a plurality of spaced holes, each of the holes aligning with an associated portion of the mount;

the holes are untapped, and aligns with a tapped hole in the mount; and the connection includes a plurality of screws extending respectively through the untapped holes in the member and into the tapped holes in the mount such that the mount can be selectively and locally drawn toward the member by adjusting selected ones of the screws.

11. A printhead assembly as set forth in claim 10 wherein:

the member has another plurality of spaced holes, each of the other plurality of holes aligning with an associated portion of the mount;

the other plurality of holes is tapped; and a second plurality of screws extends respectively through the tapped holes in the member and into butting engagement with the associated portion of the mount such that the mount can be selectively and locally pushed away from the member by adjusting the second plurality of screws.

12. A printhead assembly as set forth in claim 2 wherein:

the member has a plurality of spaced holes, each of the holes aligning with an associated portion of the mount;

the plurality of holes is tapped; and a plurality of screws extends respectively through the tapped holes in the member and into butting engagement with the associated portion of the mount such that the mount can be selectively and locally pushed away from the member by adjusting the screw.

* * * * *